US005170651A

United States Patent [19]

Errani

[11] Patent Number: 5,170,651

[45] Date of Patent: Dec. 15, 1992

[54] CYLINDER LOCK AND KEY

[75] Inventor: Deo Errani, Faenza, Italy

[73] Assignee: Costruzioni Italiane Serrature Affini C.I.S.A. S.p.A., Faenza, Italy

[21] Appl. No.: 576,048

[22] Filed: Aug. 31, 1990

[30] Foreign Application Priority Data

Sep. 6, 1989 [IT] Italy ..... 3610 A/89

[51] Int. Cl.[5] ..... E05B 27/00; E05B 19/08

[52] U.S. Cl. ..... 70/493; 70/395; 70/399

[58] Field of Search ..... 70/493, 358, 395, 397-399, 70/405-407, 409, 421

[56] References Cited

U.S. PATENT DOCUMENTS

| | | | |
|---|---|---|---|
| 1,567,979 | 12/1925 | Northrop | 70/399 X |
| 1,735,868 | 11/1929 | Klingel | 70/399 |
| 3,412,588 | 11/1968 | Schwegler | 70/406 X |
| 3,486,355 | 12/1969 | Halfyard | 70/398 X |
| 3,877,267 | 4/1975 | Harris | 70/395 X |
| 3,986,376 | 10/1976 | Lack | 70/364 |
| 4,120,184 | 10/1978 | Gerlach | 70/395 X |
| 4,325,242 | 4/1982 | Tietz | 70/407 X |
| 4,343,166 | 8/1982 | Hofmann | 70/409 X |
| 4,377,082 | 3/1983 | Wolter | 70/395 X |
| 4,612,787 | 9/1986 | Prunbauer et al. | 70/358 |
| 4,838,058 | 6/1989 | Matsumoto | 70/355 |

FOREIGN PATENT DOCUMENTS

| | | |
|---|---|---|
| 362254 | 9/1980 | Austria . |
| 2031790 | 11/1970 | France . |

*Primary Examiner*—Gary L. Smith
*Assistant Examiner*—Suzanne L. Dino
*Attorney, Agent, or Firm*—Guido Modiano; Albert Josif

[57] ABSTRACT

The cylinder lock and key comprises at least two auxiliary pins which are arranged on opposite sides with respect to the key slot and have an end which protrudes into the slot. The opposite ends of the two auxiliary pins cooperate with respective auxiliary tumbler pins which are actuated by springs and are suitable for being actuated in the position for rotation of the plug by a lever articulated in an opening of the shank of the key when the key is fully inserted in the lock.

2 Claims, 1 Drawing Sheet

CYLINDER LOCK AND KEY

BACKGROUND OF THE INVENTION

The present invention relates to a cylinder lock and key.

As known, cylinder locks are formed by a lock cylinder which rotatably contains a plug. At least one row of blind holes is defined inside the lock cylinder, and at least one row of through holes and a key slot are defined in the plug.

Pins are accommodated in said through slots, and one of their ends protrudes into the slot; tumbler pins, supported by springs, are accommodated in the blind holes. The respective key has a row of teeth defined along an edge of the shank which is inserted in the lock. The row of pins of the plug engages between the teeth of the key when said key is fully inserted in the slot, causing the alignment of the plane of contact between the pins and the tumbler pins in the plane of contact between the plug and the cylinder.

The plug can thus rotate in the cylinder, causing the rotation of the bit and the opening of the door.

The disadvantage of this type of lock and key is that it can be easily subjected of fraudulent tampering with tools such as picks which are inserted in the key slot to act on the accessible ends of the pins and move the plane of contact between the pins and the tumbler pins into the plane of contact between the plug and the cylinder.

In order to prevent lock picking as much as possible, appropriately offset ridges are defined in the key slot and hinder action on the pins. However, the key slot, due to manufacturing reasons and to reasons of mechanical resistance of the key itself, is still too wide to constitute an effective barrier against effraction attempts of the described type.

SUMMARY OF THE INVENTION

The technical aim of the present invention is therefore to provide an assembly comprising a cylinder lock and a key, the coding whereof cannot be immediately decoded from the outside and therefore hinders the mechanical action of fraudulent tools on the pins.

Within the scope of this aim, a further object is to provide an assembly which is capable of ensuring reliable operation even after prolonged use and is structurally simple so as to meet the requirements of commercial competitiveness.

This aim and this object are achieved by a cylinder lock and key, wherein said lock comprises a lock cylinder, a plug rotatably mounted in said lock cylinder coaxially thereto, a key slot defined in said plug and arranged in a diametrical plane with respect to the axis of rotation of the plug, a series of through holes defined radially in said plug and arranged in the plane of the key slot, said holes intersecting said slot, pins slidably accommodated in said through holes, a series of blind holes defined radially in the cylinder, tumbler pins slidably accommodated in said blind holes and cooperating with said pins, springs accommodated in said blind holes and actuating said tumbler pins in a position of engagement of said through holes and said pins in a position of engagement of said slot when the key is removed, characterized in that it comprises auxiliary through holes defined in said plug perpendicular and on opposite sides with respect to said plane of the key slot, said holes intersecting said slot in axially offset positions, auxiliary pins accommodated in said auxiliary through holes, auxiliary blind holes defined in said lock cylinder in a position of alignment with said auxiliary through holes when the key is removed, auxiliary tumbler pins and springs accommodated in said auxiliary blind holes and cooperating with said auxiliary pins to actuate them into the position for the engagement of the slot when the key is removed, said key having an opening in which a lever is articulated along an axis which is perpendicular to that of the plug, said lever having an end and a central portion which, when the key is fully inserted in the plug, are in contact with said auxiliary pins, the spring which acts on the auxiliary pin in contact with said central portion causing rotation of the lever in a position in which said auxiliary tumbler pins and pins allow rotation of the plug.

BRIEF DESCRIPTION OF THE DRAWINGS

The details of the invention will become apparent from the detailed description of a preferred embodiment, illustrated only by way of non-limitative example in the accompanying drawings, wherein.

DESCRIPTION OF THE PREFERRED EMBODIMENTS

Figures 1, 2:
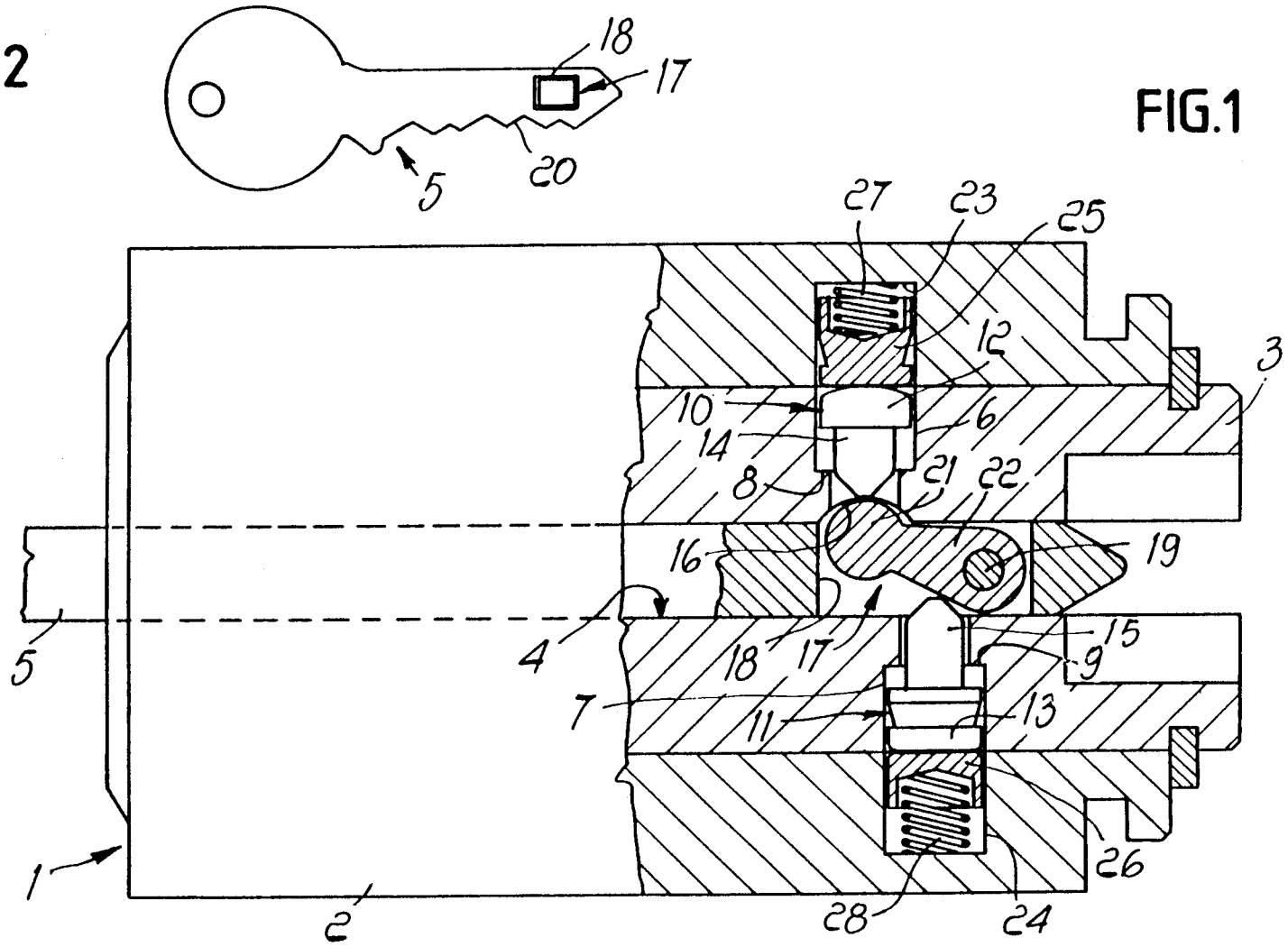
FIG. 1 is a longitudinal sectional view of the lock with the key inserted therein.
FIG. 2 is a view of the key.

With reference to the above figures, the reference numeral 1 generally indicates a lock conventionally composed of a hollow lock cylinder 2 in which a plug 3 is rotatably accommodated coaxially to the cylinder and is axially provided with a slot 4 for the insertion of the key 5. A row of through holes is defined in the plug 3 in the plane of the slot 4, and pins engaged by the set of teeth of the key when said key is inserted in the slot 4 are accommodated in said through holes.

The lock cylinder 2 also has a row of blind holes in which tumbler pins, supported by springs, are accommodated.

For the sake of brevity in description, said pins, tumbler pins and springs are not described in detail, since they are fully conventional in terms of shape and operation.

Advantageously, two auxiliary through holes 6 and 7 are defined in the plug 3 on opposite sides of the slot 4 and perpendicular thereto, and have two portions with different diameters which form a shoulder 8, 9.

The holes 6, 7, which are preferably located in the end portion of the slot 4, slidably accommodate two auxiliary pins 10, 11 which have a mushroom-like shape with a head 12, 13 which is enlarged with respect to the stem 14, 15 so as to abut with the shoulders 8, 9.

The end of the stems 14, 15 which is directed toward the slot 4 is conically pointed, and the length of said stems is such that when the key is not inserted they protrude into the slot 4 with their conical end. At the region in which the hole 8 leads into the slot 4 there is a recess 16 which has a depth which can be coded according to the length of the pin 10. The holes 6, 7 are mutually axially offset and are located so as to face a lever 17 which is contained in the body of the key when said key is inserted in the slot 4.

The lever 17 is accommodated in a substantially rectangular through opening 18 defined in the shank or blade-like portion of the key 5.

A pin 19 is mounted in the opening 18 between two longitudinal sides and is perpendicular to the axis of the plug 3.

The lever 17 is articulated on the pin 19 so as to swing about one end and is constituted by a plate which has a rectangular shape which is complementary to that of the opening 18. The free end of the plate is rounded, so as to define a cylindrical edge 21 which is connected to a central portion 22 which tapers toward said cylindrical edge 21.

When the key 5 is inserted in the slot 4, the hole 7 is aligned with the central portion 22 of the lever 17, whereas the hole 6 is aligned with the cylindrical edge 21 of said lever, allowing said lever to engage the recess 16.

Expediently, two auxiliary blind holes 23, 24 are defined in the lock cylinder 2 in the same plane as the holes 6, 7; when the key is removed, said blind holes are aligned with the holes 6, 7. Cup-shaped auxiliary tumbler pins 25, 26 are accommodated in the blind holes 23, 24. Springs 27, 28 are interposed between the tumbler pins 25, 26 and the bottom of the blind holes 23, 24 and actuate the tumbler pins inward, keeping them in contact with the heads 12, 13 of the pins 10, 11. The springs 27, 28 have a differentiated shape, and the spring 28 is stronger than the spring 27.

The operation of the cylinder lock and of the related key is easily understandable from the preceding description. When the key 5 is removed from the lock, the pins 10, 11 rest againts the shoulders 8, 9 and the tips of the stems 14, 15 protrude into the slot 4.

When the key 5 is fully inserted in the slot 4, the opening 18 is opposite to the region of intervention of the pins 10, 11. The end of the pin 11 acts on the central part 22 of the lever 17 and keeps its end 21 in contact with the pin 10.

Since the spring 28 is stronger than the spring 27, it causes the oscillation of the lever 17 until the edge 21 abuts against the wall of the recess 16. This position corresponds to a precise position of the pins 10, 11, i.e. the plane of contact between the pins 10, 11 and the tumbler pins 25, 26 is arranged in the plane of contact of the plug 3 with the lock cylinder 2. In this manner the plug 3 can rotate inside the lock cylinder 2, causing the opening of the door. By removing the key, the springs 27, 28 push the pins 10, 11 back against the shoulders 8, 9 in the position for intercepting the plug 3. As can be seen, the substantial advantage of the invention consists in the fact that in order to fraudulently align the auxiliary pins and tumbler pins it is necessary to act on the pin 10, 11 in a direction which is perpendicular to the plane of the key 5. However, the available space is equal to the thickness of the key and is therefore fully insufficient to allow intervention with picks.

The invention can be used both in locks which can be actuated by flat keys and in those which can be actuated by profiled keys. In the latter case, the opening 18 for the lever 17 is defined in a planar longitudinal region which is not affected by longitudinal grooves.

The lever 17 allows an auxiliary coding of the key. In particular, coding is possible by acting on the thickness of the tapered portion 22, i.e. on the engagement region of the pin 11, on the depth of the recess 16 and on the thickness of the edge 21, which in any case can never be greater than the thickness of the key. It should be noted that the recess 16 makes it difficult to fraudulently code the key since it cannot be detected from the outside.

The invention thus conceived is susceptible to numerous modifications and variations, all of which are within the scope of the inventive concept.

All the details may furthermore be replaced with other technically equivalent elements.

I claim:

1. In combination, a cylinder lock and key, wherein said lock comprises a lock cylinder, a plug rotatably mounted in said lock cylinder coaxially thereto, a key slot defined in said plug and arranged in a diametrical plane with respect to the axis of rotation of the plug, a series of through holes defined radially in said plug and arranged in the plane of the key slot, said holes intersecting said slot, pins slidably accommodated in said through holes, a series of blind holes defined radially in the cylinder, tumbler pins slidably accommodated in said blind holes and cooperating with said pins, springs accommodated in said blind holes and actuating said tumbler pins in a position of engagement of said through holes and said pins in a position of engagement of said slot when the key is removed, a pair of auxiliary through holes defined in said plug perpendicularly and on opposite sides with respect to said diametrical plane, said holes intersecting said slot in axially offset positions, auxiliary pins accommodated in said pair of auxiliary through holes, a pair of auxiliary blind holes defined in said lock cylinder in a position of alignment with said auxiliary through holes when the key is removed, auxiliary tumbler pins and springs accommodated in said pair of auxiliary blind holes and cooperating with said auxiliary pins to actuated them into the position for engagement of the slot when the key is removed, an opening formed in said key, a lever arranged in said opening and articulated along an axis which is perpendicular to the axis of said plug and lies in said diametrical plane, said lever having an end portion and a central portion which, when the key is fully inserted in the key slot, are engaged by said auxiliary pins, said lever having a thickness less than the thickness of the key, a recess formed in said slot at the auxiliary through hole which accommodates the auxiliary pin suitable for engaging the end portion of said lever, the spring which acts on the auxiliary pin in contact with said central portion urging said lever in a position in which said end portion engages said recess and said recess having a depth coded according to the length of said auxiliary pin to permit rotation of the plug when the key is inserted in the key slot.

2. Combination according to claim 1 wherein said lever has a cylindrical end portion and a central portion tapering towards said cylindrical end portion.

* * * * *